US008616689B2

(12) United States Patent
von Essen et al.

(10) Patent No.: US 8,616,689 B2
(45) Date of Patent: Dec. 31, 2013

(54) CIRCULATING FLUID FOR FLUID DROPLET EJECTING

(75) Inventors: Kevin von Essen, San Jose, CA (US); Paul A. Hoisington, Hanover, NH (US); Andreas Bibl, Los Altos, CA (US)

(73) Assignee: FUJIFILM Corporation, Tokyo (JP)

( * ) Notice: Subject to any disclaimer, the term of this patent is extended or adjusted under 35 U.S.C. 154(b) by 320 days.

(21) Appl. No.: 12/992,587

(22) PCT Filed: Apr. 30, 2009

(86) PCT No.: PCT/US2009/042363

§ 371 (c)(1),
(2), (4) Date: Feb. 9, 2011

(87) PCT Pub. No.: WO2009/142889

PCT Pub. Date: Nov. 26, 2009

(65) Prior Publication Data

US 2011/0128335 A1 Jun. 2, 2011

Related U.S. Application Data

(60) Provisional application No. 61/055,767, filed on May 23, 2008.

(51) Int. Cl.
*B41J 2/18* (2006.01)

(52) U.S. Cl.
USPC ..... 347/89; 347/67; 347/92

(58) Field of Classification Search
None
See application file for complete search history.

(56) References Cited

U.S. PATENT DOCUMENTS

| | | | | |
|---|---|---|---|---|
| 4,403,234 | A | 9/1983 | Miura et al. | |
| 5,017,941 | A * | 5/1991 | Drake | 347/67 |
| 5,623,292 | A | 4/1997 | Shrivastava et al. | |
| 5,771,052 | A | 6/1998 | Hine et al. | |
| 5,818,485 | A | 10/1998 | Rezanka | |
| 6,039,442 | A * | 3/2000 | Hagiwara et al. | 347/89 |

(Continued)

FOREIGN PATENT DOCUMENTS

| | | |
|---|---|---|
| JP | 09-506561 | 6/1997 |
| JP | 10-157110 | 6/1998 |
| JP | 2007-168421 | 7/2007 |
| WO | 2009/143362 | 11/2009 |

OTHER PUBLICATIONS

International Search Report and Written Opinion dated Jun. 24, 2009 issued in international application No. PCT/US2009/042363, 8 pgs.

(Continued)

*Primary Examiner* — Matthew Luu
*Assistant Examiner* — John P Zimmermann
(74) *Attorney, Agent, or Firm* — Fish & Richardson P.C.

(57) ABSTRACT

A fluid droplet ejection apparatus includes a printhead having a fluid supply and a fluid return. A substrate is attached to the printhead, and the substrate includes a fluid inlet and a fluid outlet on a surface of the substrate proximate to the fluid supply and fluid return. Nozzles are in fluid communication with the fluid inlet. The fluid inlet of the substrate is in fluid communication with the fluid supply, and the fluid outlet is in fluid communication with the fluid return. A first circulation path through the substrate is between the fluid inlet and the fluid outlet. The fluid supply is in fluid communication with the fluid return through a second circulation path that is through the printhead and not through the substrate.

24 Claims, 4 Drawing Sheets

(56) References Cited

U.S. PATENT DOCUMENTS

| | | | | |
|---|---|---|---|---|
| 6,074,035 | A | 6/2000 | Irizawa et al. | |
| 6,120,139 | A * | 9/2000 | Childers et al. | 347/92 |
| 7,040,745 | B2 * | 5/2006 | Kent | 347/89 |
| 7,331,663 | B2 | 2/2008 | Silverbrook et al. | |
| 2002/0051039 | A1 | 5/2002 | Moynihan et al. | |
| 2007/0120913 | A1 | 5/2007 | Mukai et al. | |
| 2007/0188560 | A1 | 8/2007 | Zapka et al. | |
| 2008/0079759 | A1 | 4/2008 | Nagashima | |

OTHER PUBLICATIONS

International Preliminary Report on Patentability dated Dec. 2, 2010 issued in international application No. PCT/US2009/042363, 7 pgs.

Office Action issued Jul. 2, 2013 in corresponding Japanese Patent Application No. 2011-510546, and partial English translation, 6 pgs.

* cited by examiner

CIRCULATING FLUID FOR FLUID DROPLET EJECTING

CROSS-REFERENCE TO RELATED APPLICATIONS

This application is the national stage of International Application Number PCT/US2009/042363, filed on Apr. 30, 2009, which is based on and claims the benefit of the filing date of U.S. Provisional Application No. 61/055,767, filed on May 23, 2008, both of which as filed are incorporated herein by reference in their entireties.

BACKGROUND

This description relates to fluid droplet ejection. In some fluid ejection devices, a substrate includes a fluid pumping chamber, a descender, and a nozzle. Fluid droplets can be ejected from the nozzle onto a medium, such as in a printing operation. The nozzle is fluidly connected to the descender, which is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

This invention relates to systems, apparatus, and methods for fluid droplet ejection. In one aspect, the systems, apparatus, and methods disclosed herein feature a printhead having a fluid supply and a fluid return. A substrate is attached to the printhead, the substrate having a fluid inlet and a fluid outlet on a surface of the substrate proximate to the fluid supply and the fluid return. Nozzles are in fluid communication with the fluid inlet. The fluid inlet of the substrate is in fluid communication with the fluid supply and the fluid outlet is in fluid communication with the fluid return. A first circulation path through the substrate is between the fluid inlet and the fluid outlet. The fluid supply is in fluid communication with the fluid return through a second circulation path that is through the printhead and not through the substrate.

One or more of the following features may also be included. In a fluid droplet ejection apparatus, the second circulation path can be parallel to the first circulation path. The second circulation path can have a larger average cross-sectional area that the first circulation path. A filter can be positioned in the first circulation path, the second circulation path, or both. A temperature sensor and/or a temperature control device can be in thermal communication with one or both of the first circulation path and the second circulation path. A fluid supply tank can be in fluid communication with the fluid supply. A fluid return tank can be in fluid communication with the fluid return. A fluid supply pump can be in fluid communication with the fluid supply tank and the fluid return tank. The fluid supply pump can control a height of fluid in the fluid supply tank and/or can control a difference in fluid height between the fluid supply tank and the fluid return tank. Any fluid path between the supply pump and the substrate can include either the fluid supply tank or the fluid return tank or both. The fluid supply can be in fluid communication with the fluid return through a bypass circulation path that is different from the first circulation path and the second circulation path.

In another aspect, the systems, apparatus, and methods disclosed herein feature flowing a first flow of fluid in a sequence of flowing the fluid through a fluid supply of a printhead, a fluid inlet of a substrate attached to the printhead, a fluid outlet of the substrate, and to a fluid return of the printhead, and simultaneous with flowing the first flow of fluid, flowing a second flow of fluid from the fluid supply to the fluid return, wherein the second flow of fluid does not pass through the substrate, the second flow of fluid being greater than the first flow of fluid, wherein the first flow of fluid is in fluid communication with the second flow of fluid.

One or more of the following features may also be included. The second flow of fluid can cause a lower pressure at the fluid outlet of the substrate than at the fluid inlet of the substrate. A method can also include ejecting fluid droplets through nozzles in fluid communication with the fluid inlet. A method can also include, simultaneous with flowing the first flow of fluid and the second flow of fluid, flowing a third flow of fluid from the fluid return to the fluid supply, wherein the third flow of fluid does not pass through the substrate or the printhead. A method can also include removing air or other contaminants from fluid in the third flow of fluid. The third flow of fluid can flow from the fluid return, through a fluid return tank, through a fluid supply tank, and to the fluid supply. A method can also include controlling a difference in fluid height between the fluid return tank and the fluid supply tank. The difference in fluid height between the fluid return tank and the fluid supply tank can be controlled by a fluid supply pump. A method can also include controlling a height of fluid in the fluid supply tank. The height of fluid in the fluid supply tank can be controlled by a fluid supply pump. A method can also include monitoring and/or controlling a temperature of fluid in the first flow of fluid or the second flow of fluid.

These general and specific aspects may be implemented, separately or in any combination, using a system, an apparatus, a method, or any combination of systems, apparatus, and methods.

In some implementations, one or more of the following advantages may be provided. Circulating fluid through the substrate can remove air bubbles, aerated ink, debris, and other contaminants from the substrate. Circulating fluid from a fluid inlet to a fluid outlet without the fluid passing through the substrate can cause a pressure drop across the substrate that causes flow of fluid through the substrate. This configuration can cause a flow of fluid through the substrate without pumping fluid directly into or out of the substrate, thereby isolating the substrate from pressure disturbances typically caused by a pump. Flowing heated or cooled fluid both over and through the substrate can regulate the temperature of both the substrate and of the fluid flowing through the substrate. When fluid ejected by the substrate is kept at a constant temperature over a printing operation, the size of each fluid droplet that is expelled can be tightly controlled. Such control can result in uniform printing over time and can eliminate wasted warm up or practice printing runs.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Fluid droplet ejection can be implemented with a printhead and a substrate, such as a silicon substrate, that is part of the printhead. The substrate can include a fluid flow path body. The flow path body can include a microfabricated fluid flow path, which includes a nozzle for ejecting fluid droplets. Fluid can be ejected onto a medium, and the printhead and the medium can undergo relative motion during fluid droplet ejection. The fluid can be, for example, a chemical compound, a biological substance, or ink. The fluid can be continuously circulated through the flow path and fluid that is not ejected out of the nozzle can be directed through a recirculation passage. The substrate can include multiple fluid flow paths and multiple nozzles.

A system for fluid droplet ejection can include the substrate described. The system can also include a fluid supply for the substrate, as well as a fluid return for fluid that is flowed through the substrate but is not ejected out of a nozzle. A fluid supply tank can be fluidly connected to the substrate for supplying fluid to the substrate for ejection. Fluid flowing out of the substrate can be directed to a fluid return tank. Fluid can be supplied to the fluid return tank from a fluid reservoir, and fluid can be supplied to the fluid supply tank from the fluid return tank. The levels of fluid in the fluid supply tank and the fluid return tank can be controlled by pumps. The printhead can also include a second fluid flow path that is not through the substrate.

Figure 1A:
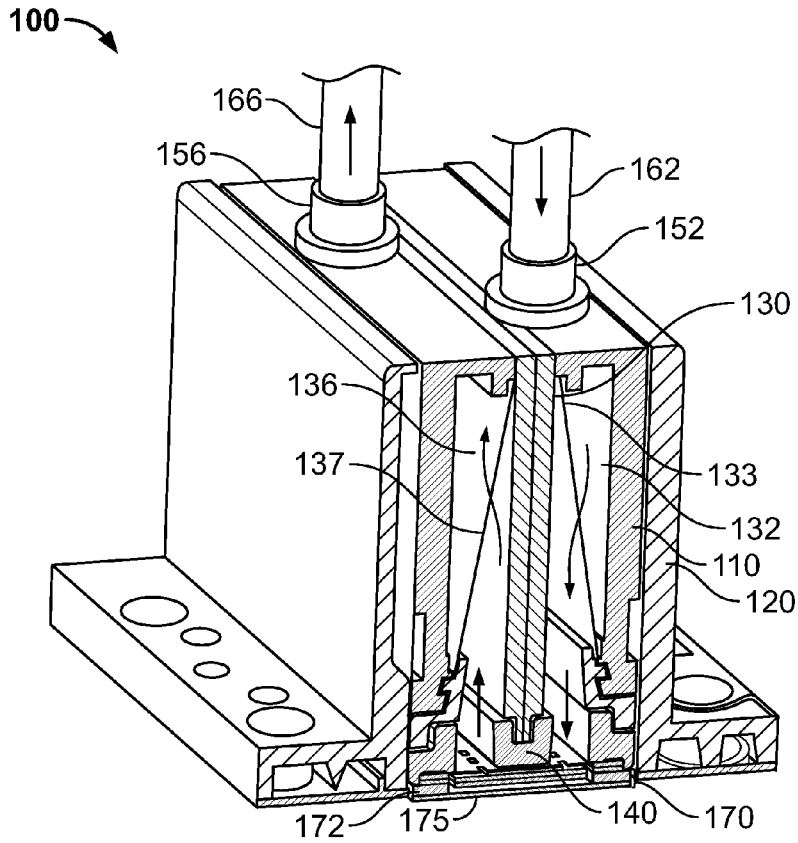
FIG. 1A is a cross-sectional perspective view of an apparatus for fluid droplet ejection.

FIG. 1A shows an implementation of a printhead 100 for ejecting fluid droplets. The printhead 100 includes an inner casing 110 and an outer casing 120. The outer casing 120 is configured to mount the printhead 100 to a print frame (not shown). An upper divider 130 and a lower divider 140 divide the printhead into a supply chamber 132 and a return chamber 136. The supply chamber 132 and the return chamber 136 include a supply chamber filter 133 and a return chamber filter 137, respectively. The supply chamber 132 and the return chamber 136 are in fluid communication with a supply connector 152 and a return connector 156, respectively. The supply connector 152 and the return connector 156 are fitted with an inlet tube 162 and an outlet tube 166, respectively. Flow of fluid in the printhead 100 is represented by arrows in FIG. 1A. The printhead 100 includes a substrate 170, and the substrate 170 includes a flow path body 172. The substrate 170 also includes a nozzle layer 175 secured to a bottom surface of the flow path body 172. The nozzle layer 175 is shown with exaggerated thickness relative to the flow path body 172 for illustrative purposes. In some implementations, the substrate 170 can be composed of silicon.

Figure 1B:
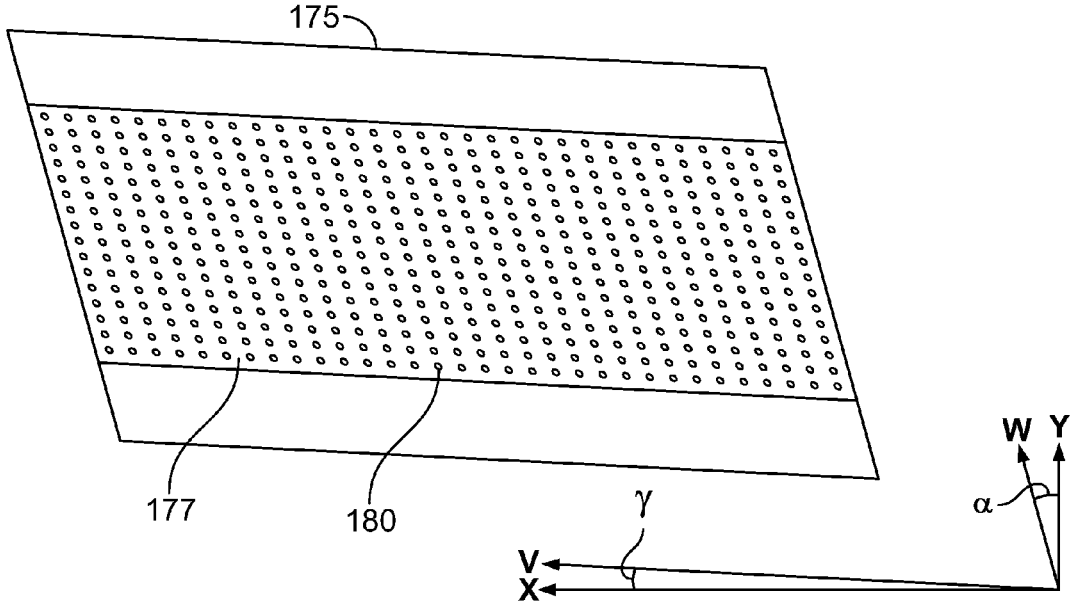
FIG. 1B is a plan view of a bottom of the apparatus of FIG. 1A.

FIG. 1B is a planar bottom view of the printhead 100 of FIG. 1A showing the nozzle layer 175. The nozzle layer 175 has a nozzle face 177 that includes nozzles 180. The x direction and the y direction are perpendicular directions along the length and width of the printhead 100, respectively. The short edges of the nozzle layer 175 are oriented in a w direction that is at an angle $\alpha$ with respect to the y direction. The long edges of the nozzle layer 175 are oriented in a v direction that is at an angle $\gamma$ with respect to the x direction. The flow path body 172 can include fluid pumping chambers (not shown), and transducers (not shown) can be provided for causing ejection of fluid droplets from the nozzles 180. For example, transducers can be attached to a surface of the substrate 170 opposite the nozzle layer 175.

Figure 2:
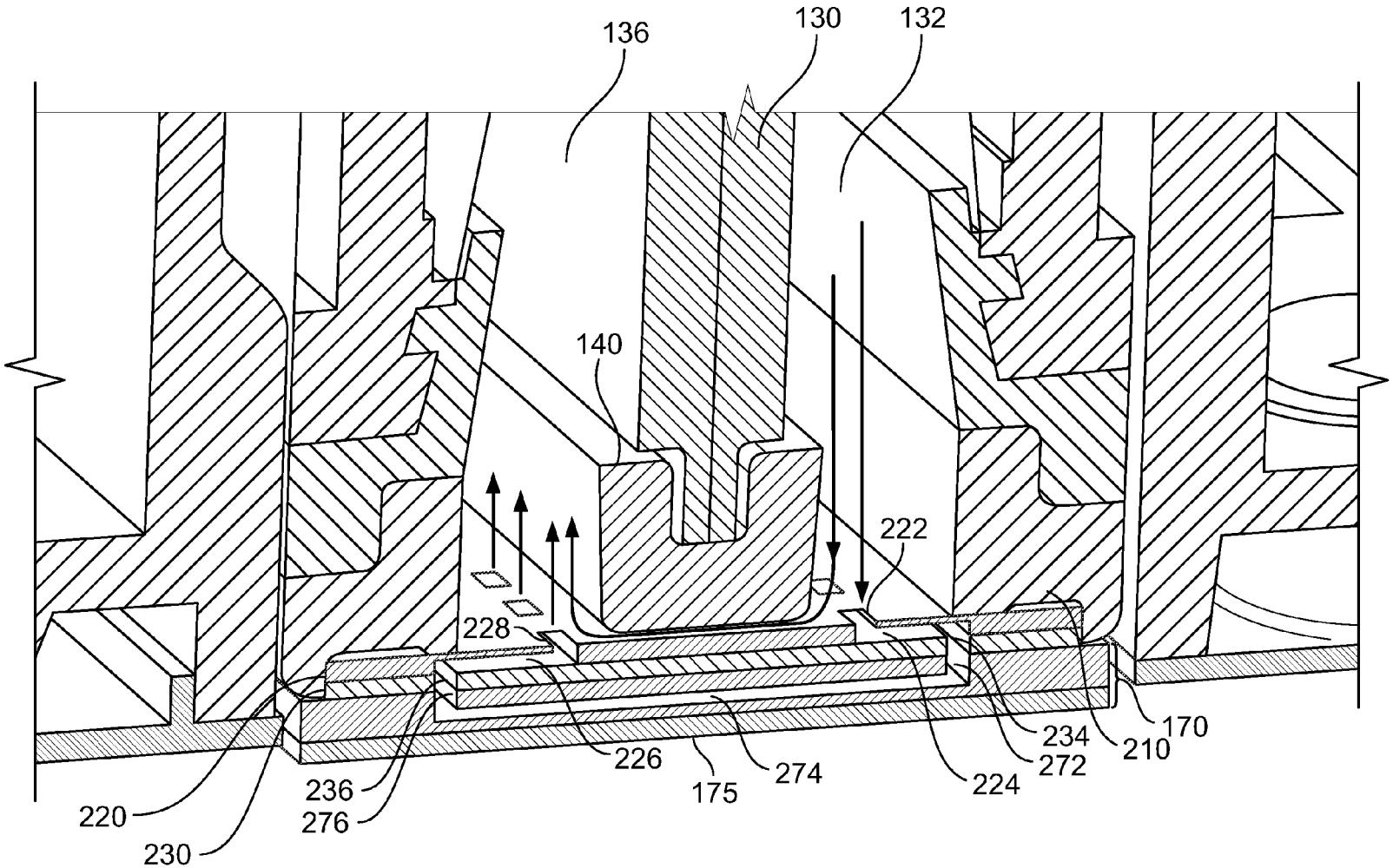
FIG. 2 is a cross-sectional perspective view of a portion of the apparatus of FIG. 1A.

FIG. 2 is a close-up view of a portion of the printhead 100 shown in FIG. 1A. In this implementation, a bottom of the fluid supply chamber 132 and the fluid return chamber 136 is defined by an upper interposer 220. The upper interposer 220 includes an upper interposer fluid supply inlet 222 and an upper interposer fluid return outlet 228, which can be formed as apertures in portions of an upper surface of the upper interposer 220 exposed to the fluid supply chamber 132 and the fluid return chamber 136, respectively. The upper interposer 220 can be attached to a lower printhead casing 210, such as by bonding, friction, or some other suitable mechanism. A lower interposer 230 is positioned between the upper interposer 220 and the substrate 170. The substrate 170 has a substrate fluid path 274, which is shown simplified as a single straight passage for illustrative purposes in FIG. 2. Flow of fluid in this portion of the printhead 100, such as flow into and out of the upper interposer 220, is represented by arrows in FIG. 2. Some implementations of the substrate 170 can include multiple substrate fluid paths 274.

The upper interposer 220 includes an upper interposer fluid supply path 224 and an upper interposer fluid return path 226. The lower interposer 230 includes a lower interposer fluid supply path 234 and a lower interposer fluid return path 236. The substrate 170 includes a substrate fluid supply inlet 272 and a substrate fluid return outlet 276. The substrate fluid path 274 is configured to fluidly connect the substrate fluid supply inlet 272 and the substrate fluid return outlet 276. The substrate fluid supply inlet 272 can be configured for fluid to flow from into the substrate 170 during operation, as discussed below. Nozzles 180 (FIG. 1B) are in fluid communication with the substrate fluid path 274. The nozzles 180 (FIG. 1B) can be fluidly connected to one another but can be separated by intermediate passages (not shown). The upper interposer fluid supply path 224 is configured to fluidly connect the upper interposer fluid supply inlet 222 to the lower interposer fluid supply path 234, which is in turn fluidly connected to the substrate fluid supply inlet 272. The lower interposer fluid return path 236 is configured to fluidly connect the substrate fluid return outlet 276 to the upper interposer fluid return path 226, which is in turn fluidly connected to the upper interposer fluid return outlet 228.

Figure 3:
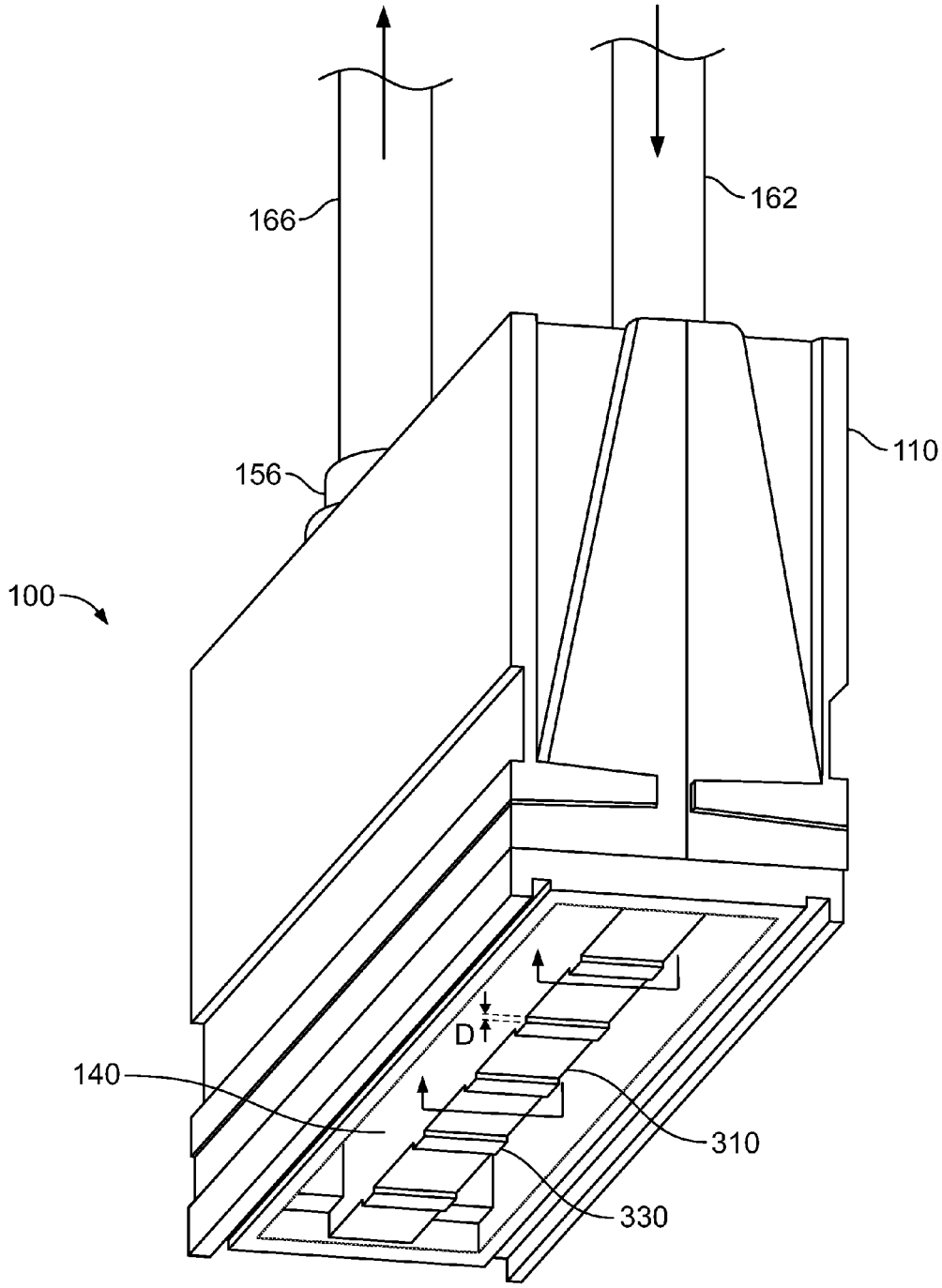
FIG. 3 is a perspective view of a portion of an apparatus for fluid droplet ejection.

FIG. 3 shows the printhead 100 as viewed from below and without the outer casing 120, substrate 170, upper interposer 220, or lower interposer 230. The inlet tube 162 and the outlet tube 166 can be made of a flexible material, such as an elastomeric rubber or other suitable tubing material. Alternatively, the inlet tube 162 and the outlet tube 166 can be made of a rigid or semi-rigid material, such as aluminum, copper, steel, or other suitable material. In some embodiments, the lower divider 140 includes divider passages 310 configured to fluidly connect the supply chamber 132 and the return chamber 136. The divider passages 310 can be separated by divider supports 330. The divider supports 330 can provide a location for the lower divider 140 to be bonded to the upper interposer 220. The divider supports 330 can also facilitate control of the size of the divider passages 310, particularly the cross-sectional area thereof. Accurate control of the cross-sectional area of the divider passages 310 can be important in controlling the rate of heat transfer between the fluid and the substrate 170 and, in turn the nozzles 180. Without being limited to any particular theory, heat transfer can be a function of the flow rate of fluid through the divider passages 310, which can in turn be a function of the cross-sectional area thereof. Alternatively, the divider supports 330 can be omitted and a single divider passage 310 provided. For example, the upper interposer 220 can be bonded to the lower printhead casing 210 and the lower divider 140 can be free of divider supports 330, thereby allowing for fluid to flow under an entirety of the lower divider 140 during operation.

In some implementations, a height D of the divider passages 310 can be between about 50 microns and about 300 microns, for example, 160 microns. In implementations whether the divider passages 310 are flush with the upper interposer 220, the height D of the divider passages 310 can be a distance between the upper interposer 220 and the lower divider 140. In some implementations, the divider passages 310 are separated by the divider supports 330 into six divider passage segments, each segment measuring about 4.6 millimeters by about 5.8 millimeters and having a height D of about 160 microns. The divider passages 310 can be flush with the upper interposer 220. Alternatively, the divider passages 310 can be otherwise in thermal communication with the nozzles 180. For example, the divider passages 310 can be positioned closer to the middle of the height of the printhead 100, at some distance from the upper interposer 220.

For a particular fluid, a particular temperature or range of temperatures may be desired for the fluid at the nozzles 180. For example, a particular fluid may be physically, chemically, or biologically stable within a desired range of temperatures. Also, a particular fluid may have desired or optimal ejection characteristics, or other characteristics, within a desired range of temperatures. Controlling the temperature of the fluid at the nozzles 180 can also facilitate uniformity of fluid droplet ejection, since the ejection characteristics of a fluid may vary with temperature. The temperature of the fluid at the nozzles 180 can be controlled by controlling the temperature of the nozzles 180. To maintain a desired temperature, fluid flowing through the divider passages 310 can be thermally coupled to the nozzles 180. For example, a path of thermal communication between the divider passages 310 and the nozzles 180 can include good thermal conductors, such as silicon, rather than poor thermal conductors, such as plastic. Fluid flowing through the divider passages 310 can be temperature-controlled (e.g., heated fluid or cooled fluid).

The divider passages 310 can function as a heat exchanger between the nozzles 180 and the fluid. Configuration of the dimensions of the divider passages 310 can depend in part upon a minimum, desired, or maximum attainable efficiency, $e_n$, of the divider passages 310 as a heat exchanger. The efficiency, $e_n$, can be equal to a residence time, $T_r$, of the fluid in the divider passages 310 divided by a thermal diffusion time constant, T, of this heat exchanger. The residence time, $T_r$, can be equal to a fluid volume of the divider passages 310 divided by a flow rate of fluid through the divider passages 310. The thermal diffusion time constant, T, can depend on the height D of the divider passages 310 and a diffusivity, $\alpha$, of the fluid therein, e.g., $T=D^2/\alpha$. The diffusivity, $\alpha$, of the fluid can depend on a thermal conductivity of the fluid, $K_T$, a density of the fluid, $\rho$, and a specific heat of the fluid, $C_P$, such as in the relationship: $\alpha=K_T/(\rho\cdot C_P)$. The divider passages 310, and the flow rate of fluid therein, can be configured to achieve an efficiency, $e_n$, sufficiently high to maintain the nozzles 180 at the desired temperature or within the desired temperature range.

The divider passages can be configured to maintain substantially all of the nozzles 180 at a predetermined temperature or within a predetermined temperature range. A degree of thermal conductivity through the fluid, $K_I$, can depend on the density of the fluid, $\rho$, the specific heat of the fluid, $C_P$, a flow rate of the fluid through the divider passages 310, Q, and the efficiency, $e_n$, of the divider passages 310 as a heat exchanger (discussed above), e.g. $K_I=(\rho\cdot C_P\cdot Q\cdot e_n)$. The efficiency, $e_n$, and the thermal conductivity through the fluid, $K_I$, can depend upon, for example, a length, height, surface area, and path of the divider passages 310, as well as a volume of the fluid in the divider passages 310 at an instant in time. The divider passages 310 can also be configured in light of thermal conductivity between the nozzles 180 and other components or a surrounding environment. For example, heat can be transferred from the nozzles 180 to the surrounding environment by conduction, convection (such as with air), and radiation. Conduction may occur through some or all of the substrate 170, the inner casing 110, and the outer casing 120. Conduction may also occur through a print frame (not shown) to which the printhead 100 can be attached. Convection may be facilitated by air movement caused by relative motion near the nozzles 180 of the medium onto which fluid droplets can be ejected. Thermal conductivity through any and all paths other than through the fluid may be expressed collectively as the thermal conductivity to the environment, $K_E$. In some implementations, such as in an "open loop" loop system where a temperature of the fluid is not set in response to a measurement of a temperature of the nozzles 180, the ratio of $K_I$:$K_E$ can be at least about 5:1, such as about 20:1. In "closed loop" implementations, wherein a temperature of the nozzles 180 is measured and the temperature of the fluid can be adjusted in response thereto, the ratio of $K_I$:$K_E$ can be at least about 2:1, such as about 10:1.

Configuration of the divider passages 310 for thermal conductivity between the divider passages 310 and the nozzles 180 can also depend on overall printhead size, quantity of nozzles 180, and size of nozzles 180. For example, a relatively greater number of nozzles 180 may require a relatively greater thermal conductivity to maintain the nozzles 180 at a predetermined temperature or within a predetermined temperature range. The dimensions and path of the divider passages 310, and the flow rate of fluid therein, can be configured to achieve a degree of thermal conductivity sufficient to maintain the nozzles 180 at the desired temperature or within the desired range of temperatures.

In some implementations, the divider passages 310 can span a full length of the printhead 100. Such an arrangement can minimize non-uniformity in thermal conductivity between the divider passages 310 and the nozzles 180.

Figure 4:
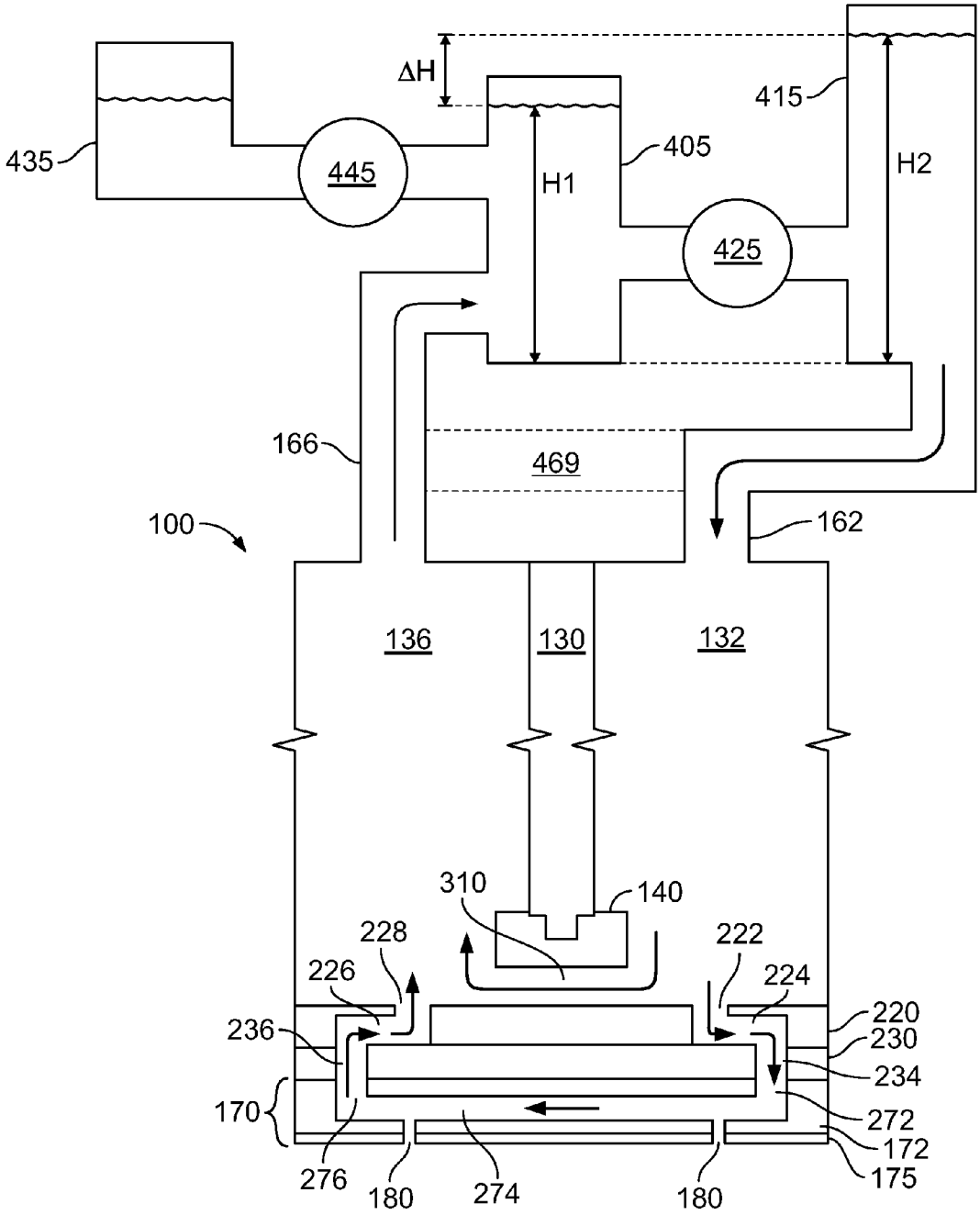
FIG. 4 is a schematic showing a system for fluid droplet ejection.

FIG. 4 is a schematic representation of an implementation of a system for circulating fluid through the printhead 100 and the substrate 170. The system can include one or more printheads 100, however only one printhead 100 is shown in FIG. 4 for the sake of simplicity. The substrate fluid path 274 and the nozzles 180 have been simplified for illustrative purposes. A fluid return tank 405 is fluidly connected to a fluid supply tank 415, and a supply pump 425 is configured to maintain a predetermined height difference $\Delta H$ between a height of fluid in the fluid return tank 405, herein referred to as a return fluid height H1, and a height of fluid in the fluid supply tank 415, herein referred to as a supply fluid height H2. That is, the height difference $\Delta H$ represents the difference in elevation between the return fluid height H1 and the supply fluid height H2 with respect to a common reference elevation, represented in FIG. 4 by a broken line between the fluid return tank 405 and the fluid supply tank 415. Alternatively, the supply pump 425 can be configured to control the supply fluid height H2 without regard for the return fluid height H1. The height difference $\Delta H$ can cause a flow of fluid to the printhead 100, including through the substrate 170, as discussed in more detail below. A fluid reservoir 435 is fluidly connected to the fluid return tank 405. A reservoir pump 445 is configured to maintain the return fluid height H1 in the fluid return tank 405 at a predetermined level.

The fluid return tank 405 is fluidly connected to the return chamber 136 by the outlet tube 166 and the return connector 156 (see FIG. 1A). The fluid supply tank 415 is fluidly connected to the supply chamber 132 by the inlet tube 162 and the supply connector 152 (see FIG. 1A). Optionally, a bypass 469 can be configured to permit flow of fluid between the supply tube 162 and the return tube 166 or, alternatively, between the supply connector 152 and the return connector 156. The bypass 469 can be, for example, a tube made of flexible material, rigid material, or other suitable material. The bypass 469 can also be a passage formed in the printhead 100, such as in the inner casing 110, the outer casing 120, or elsewhere.

During operation of some implementations, the height difference ΔH causes a pressure in the supply tube 162 to be greater than a pressure in the return tube 166. As a result, a pressure in the supply chamber 132 is higher than a pressure in the return chamber 136. This pressure difference causes flow from the supply tube 162 through the supply chamber 132, the divider passages 310, and the return chamber 136 to the return tube 166. This flow of fluid from the supply chamber 132 to the return chamber 136 causes a pressure at the upper interposer fluid return outlet 228 to be lower than a pressure at the upper interposer fluid supply inlet 222. This pressure difference causes flow of fluid from the supply chamber 132 through the upper interposer fluid supply inlet 222, the upper interposer fluid supply path 224, the lower interposer fluid supply path 234, the substrate fluid supply inlet 272, the substrate fluid path 274, the substrate fluid return outlet 276, the lower interposer fluid return path 236, the upper interposer fluid return path 226, and the upper interposer fluid outlet 228 to the return chamber 136. A flow rate of fluid through the printhead 100 is typically much higher than a flow rate of fluid through the substrate 170. That is, of the fluid flowing into the printhead 100, most of the fluid can circulate through the divider passages 310 to the return tube 166. For example, a flow rate of fluid into the printhead 100 can be more than two times greater than a flow rate of fluid into the substrate 170. In some implementations, the flow rate of fluid into the printhead 100 can be between about 30 times and about 70 times greater than the flow rate of fluid into the substrate 170. These ratios can vary depending on whether or not the flow rates are considered during fluid droplet ejection, and if so, depending on the frequency of fluid droplet ejection. For example, during fluid droplet ejection, the flow rate of fluid into the substrate 170 can be higher relative to the flow rate of fluid into the substrate 170 when no fluid droplet ejection is occurring. As a result, the ratio of the flow rate of fluid into the printhead 100 to the flow rate of fluid into the substrate 170 can be lower during fluid droplet ejection relative to when no fluid droplet ejection is occurring.

Further, in some implementations, a flow rate of fluid through the substrate 170 can be greater than a total flow rate of fluid through the nozzles 180. For example, it can be that during a fluid ejecting operation, only a fraction of the fluid flowing into the substrate 170 is ejected from the substrate 170 through the nozzles 180. Alternatively, the flow rate of fluid through the nozzles 180 during fluid droplet ejection can be greater than a flow rate of fluid that is circulated through the substrate 170 from the supply chamber 132 to the return chamber 136. In some other implementations, flow of fluid through the substrate fluid return outlet 276 can momentarily reverse during a fluid ejecting operation. That is, fluid can momentarily flow into the substrate 170 from both the supply chamber 132 and the return chamber 136. These flow rates and flow directions of fluid through the nozzles 180 can depend on a frequency of fluid droplet ejection during operation.

In some implementations, circulating fluid through the substrate 170 can prevent drying of fluid in the substrate 170, such as near the nozzles 180, and can remove contaminants from the substrate fluid path 274. Contaminants can include air bubbles, aerated fluid (i.e., fluid containing dissolved air), debris, dried fluid, and other objects that may interfere with fluid droplet ejection. If the fluid is ink, contaminants can also include dried pigment or agglomerations of pigment. Removing air bubbles is desirable because air bubbles can absorb or detract from energy imparted by the transducers and fluid pumping chambers, which can prevent fluid droplet ejection or cause improper fluid droplet ejection. The effects of improper droplet ejection can include varying the size, speed, and/or direction of an ejected fluid droplet. Removal of aerated fluid is also desirable because aerated fluid is more likely to form bubbles than deareated fluid. Other contaminants, such as debris and dried fluid, can similarly interfere with proper fluid droplet ejection, such as by blocking a nozzle 180.

Optionally, a degasser (not shown) can be configured to deaerate fluid and/or to remove air bubbles from the fluid. The degasser can be fluidly connected between the return chamber 136 and the fluid return tank 405, between the fluid return tank 405 and the fluid supply tank 415, between the fluid supply tank 415 and the supply chamber 132, or some other suitable location. A system filter (not shown), also optional, can be configured to remove contaminants from the fluid. The system filter may also prevent air bubbles from reaching the substrate 170. The system filter can be used in addition to the supply chamber filter 133 and the return chamber filter 137. The system filter can be fluidly connected between the return chamber 136 and the fluid return tank 405, between the fluid return tank 405 and the fluid supply tank 415, between the fluid supply tank 415 and the supply chamber 132, or some other suitable location.

In some implementations, circulating fluid through the printhead 100 and the substrate 170 can also help to maintain the substrate 170 and/or the nozzles 180 at a desired temperature. Fluid droplet ejection characteristics, such as fluid droplet size and speed, may vary with temperature. The mass of fluid in the substrate 170 can be small, and thermal conductivity between the substrate 170 and the fluid may be high. As a result, a temperature of the substrate 170 may locally change a temperature of the fluid prior to ejection through the nozzles 180. Circulating temperature-controlled fluid in the supply chamber 132, in the divider passages 310, and in the return chamber 136 can facilitate control of the temperature of the substrate 170. Uniformity of fluid temperature can thereby be improved. Fluid temperature can be monitored with a temperature sensor (not shown) in thermal communication with the fluid. The temperature sensor can be placed in, or attached to, the printhead 100, the supply tube 162, the return tube 166, the fluid supply tank 415, the fluid return tank 405, or some other suitable location. A fluid temperature control device, such as a heater (not shown), can be placed in the system and configured to control the temperature of fluid. Circuitry (not shown) can be configured to detect and monitor a temperature reading of the temperature sensor and, in response, control the heater to maintain the fluid at a desired or predetermined temperature. In some implementations, the temperature sensor can be positioned in or near the heater. In some implementations, a cooler or other temperature control device can be used in place of, or in addition to, the heater.

In implementations with a bypass 469, circulating fluid above the printhead 100 can cause a flow of fluid through the printhead 100. In implementations with a system filter and/or a degasser, circulating fluid through the bypass 469 can increase the flow of fluid through the system filter or the degasser or both, thereby improving removal of air bubbles, aerated fluid, and contaminants from the fluid. Circulating fluid through the bypass 469 can also reduce an amount of time required for priming the system. In particular, priming time can be reduced for the supply tube 162, the return tube 166, and any other components fluidly connected between the fluid supply tank 415 and the fluid return tank 405, such as the optional system filter or degasser.

In the implementation shown in FIG. 4, no pump is fluidly connected between the substrate 170 and the fluid return tank 405 or between the fluid supply tank 415 and the substrate 170. The fluid return tank 405 and the fluid supply tank 415 at least partially isolate the substrate 170 from any pressure disturbances caused by the supply pump 425. Pressure disturbances can occur as a result of vibration or other pressure variations that a pump typically produces, and these disturbances can interfere with proper fluid droplet ejection. Further, the disturbances may not affect all nozzles 180 equally, thus potentially causing non-uniformity in fluid droplet ejection characteristics among multiple nozzles 180. Isolating the supply pump 425 from the substrate 170 thereby improves uniformity of fluid droplet ejection by mitigating or preventing disturbances that could be introduced to the substrate 170 by the supply pump 425.

The use of terminology such as "front," "back," "top," "bottom," "above," and "below" throughout the specification and claims is for illustrative purposes only, to distinguish between various components of the system, printhead, and other elements described herein. The use of such terminology does not imply a particular orientation of the printhead or any other components. Similarly the use of any horizontal or vertical terms to describe elements is in relation to the implementations described. In other implementations, the same or similar elements can be oriented other than horizontally or vertically as the case may be.

A number of embodiments of the invention have been described. Nevertheless, it will be understood that various modifications may be made without departing from the spirit and scope of the invention. For example, multiple circulation paths can be arranged between the fluid supply tank and the fluid return tank. In other implementations, the fluid return tank can be omitted and the fluid flowing out of the substrate can be discarded, and the fluid supply tank and the fluid reservoir can be configured accordingly. In other implementations, passages and flow rates can be configured for momentarily reversing flow of fluid through all or a portion of the substrate fluid path during fluid droplet ejection. In some implementations, the divider passages can be tubular, circular, some other suitable shape, or arranged in some other heat exchanger configuration, such as including multiple fins or plates for improving heat transfer. Accordingly, other embodiments are within the scope of the following claims.

What is claimed is:

1. A fluid droplet ejection apparatus comprising:

a printhead having a fluid supply and a fluid return; and a substrate attached to the printhead, the substrate having a fluid inlet and a fluid outlet on a surface of the substrate proximate to the fluid supply and the fluid return, and nozzles in fluid communication with the fluid inlet, wherein the fluid inlet of the substrate is in fluid communication with the fluid supply and the fluid outlet is in fluid communication with the fluid return, wherein a first circulation path through the substrate is between the fluid inlet and the fluid outlet, wherein the fluid supply is in fluid communication with the fluid return through a second circulation path that is through the printhead and not through the substrate, the apparatus comprises a fluid path configured such that a fluid flowing along the fluid path splits and flows simultaneously into the first circulation path and the second circulation path when flowing from the fluid supply to the fluid return.

2. The apparatus of claim 1, wherein the second circulation path is parallel to the first circulation path.

3. The apparatus of claim 1, wherein the second circulation path has a larger average cross-sectional area than the first circulation path.

4. The apparatus of claim 1, further comprising:

a filter positioned in the first circulation path, the second circulation path, or both.

5. The apparatus of claim 1, further comprising:

a temperature sensor in thermal communication with one or both of the first circulation path and the second circulation path.

6. The apparatus of claim 1, further comprising:

a fluid temperature control device in thermal communication with the first circulation path, the second circulation path, or both.

7. The apparatus of claim 1, further comprising:

a fluid supply tank in fluid communication with the fluid supply; and a fluid return tank in fluid communication with the fluid return.

8. The apparatus of claim 7, further comprising:

a fluid supply pump in fluid communication with the fluid supply tank and the fluid return tank.

9. The apparatus of claim 8, wherein the fluid supply pump controls a difference in fluid height between the fluid supply tank and the fluid return tank.

10. The apparatus of claim 8, wherein the fluid supply pump controls a height of fluid in the fluid supply tank.

11. The apparatus of claim 8, wherein any fluid path between the supply pump and the substrate includes either the fluid supply tank or the fluid return tank or both.

12. The apparatus of claim 1, wherein the fluid supply is in fluid communication with the fluid return through a bypass circulation path that is different from the first circulation path and the second circulation path.

13. A method for fluid droplet ejection, comprising:

flowing a first flow of fluid in a sequence of flowing the fluid through a fluid supply of a printhead, a fluid inlet of a substrate attached to the printhead, a fluid path defined within the substrate, a fluid outlet of the substrate, and to a fluid return of the printhead; and simultaneous with flowing the first flow of fluid, flowing a second flow of fluid from the fluid supply to the fluid return, wherein the second flow of fluid does not pass through the fluid path defined within the substrate, the second flow of fluid being greater than the first flow of fluid, wherein the first flow of fluid is in fluid communication with the second flow of fluid, and the first flow of fluid is parallel to the second flow of fluid.

14. The method of claim 13, wherein the second flow of fluid causes a lower pressure at the fluid outlet of the substrate than at the fluid inlet of the substrate.

15. The method of claim 13, further comprising:
ejecting fluid droplets through nozzles in fluid communication with the fluid inlet.

16. The method of claim 13, further comprising:
simultaneous with flowing the first flow of fluid and the second flow of fluid, flowing a third flow of fluid from the fluid return to the fluid supply, wherein the third flow of fluid does not pass through the substrate or the printhead.

17. The method of claim 16, further comprising:
removing air or other contaminants from fluid in the third flow of fluid.

18. The method of claim 16, wherein the third flow of fluid flows from the fluid return, through a fluid return tank, through a fluid supply tank, and to the fluid supply.

19. The method of claim 18, further comprising:
controlling a difference in fluid height between the fluid return tank and the fluid supply tank.

20. The method of claim 19, wherein the difference in fluid height between the fluid return tank and the fluid supply tank is controlled by a fluid supply pump.

21. The method of claim 18, further comprising:
controlling a height of fluid in the fluid supply tank.

22. The method of claim 21, wherein the height of fluid in the fluid supply tank is controlled by a fluid supply pump.

23. The method of claim 13, further comprising:
monitoring a temperature of fluid in the first flow of fluid or the second flow of fluid.

24. The method of claim 23, further comprising:
controlling a temperature of fluid in the first flow of fluid or the second flow of fluid.

* * * * *